US010165846B1

(12) United States Patent
Gordon et al.

(10) Patent No.: US 10,165,846 B1
(45) Date of Patent: Jan. 1, 2019

(54) BACKPACKS WITH COOPERATIVELY ADJUSTED HIP BELTS AND COMPRESSION STRAPS

(71) Applicant: CamelBak Products, LLC, Petaluma, CA (US)

(72) Inventors: William Gordon, Petaluma, CA (US); Trevor Raymond Hunt, Whistler (CA); Damien John Kelly, Garibaldi Highlands (CA)

(73) Assignee: CamelBak Products, LLC, Petaluma, CA (US)

( * ) Notice: Subject to any disclaimer, the term of this patent is extended or adjusted under 35 U.S.C. 154(b) by 0 days.

(21) Appl. No.: 16/007,348

(22) Filed: Jun. 13, 2018

Related U.S. Application Data

(60) Provisional application No. 62/520,908, filed on Jun. 16, 2017.

(51) Int. Cl.
*A45F 3/04* (2006.01)
*A45F 3/20* (2006.01)
*A45F 3/16* (2006.01)

(52) U.S. Cl.
CPC ..... *A45F 3/047* (2013.01); *A45F 3/20* (2013.01); *A45F 2003/045* (2013.01); *A45F 2003/166* (2013.01)

(58) Field of Classification Search
CPC .... A45F 3/04; A45F 3/047; A45F 3/14; A45F 3/06; A45F 2003/045; A45F 2003/166; A45F 2003/007
See application file for complete search history.

(56) References Cited

U.S. PATENT DOCUMENTS 828,891 A 8/1906 Krueger
1,397,161 A * 11/1921 Clemetson ..... A45F 3/04 224/579
1,696,191 A * 12/1928 Coulson ..... A45F 3/10 224/627
2,262,313 A * 11/1941 Clappier ..... A45F 3/04 224/655

(Continued)

OTHER PUBLICATIONS

Photos of Patagonia Endurance Pack, circa 2006.

(Continued)

*Primary Examiner* — Corey N Skurdal
(74) *Attorney, Agent, or Firm* — Dascenzo Intellectual Property Law, P.C.; David S. D'Ascenzo

(57) ABSTRACT

Backpacks with cooperatively adjusted hip belt segments and compression strap segments. A backpack includes a pack body, a shoulder strap, and a belt assembly. The pack body includes a back panel and an exterior panel. The belt assembly includes a compression strap segment, a hip belt segment, an adjustment strap, and a releasable fastener. The backpack includes a belt assembly waist loop with a belt assembly waist perimeter. Each adjustment strap is configured to selectively adjust each of the pack volume and the belt assembly waist perimeter. The belt assembly is configured such that, responsive to the user applying a tension force to the adjustment strap, each of a pack volume and the belt assembly waist perimeter decreases by a respective degree that depends upon a ratio of the force required to decrease the pack volume to the force required to decrease the belt assembly waist perimeter.

20 Claims, 11 Drawing Sheets

(56) References Cited

U.S. PATENT DOCUMENTS

| | | | | |
|---|---|---|---|---|
| 4,090,650 | A | 5/1978 | Gotta | |
| 4,139,130 | A | 2/1979 | Glusker et al. | |
| 4,176,772 | A | 12/1979 | Danon | |
| 4,265,381 | A | 5/1981 | Muscatell | |
| 4,449,654 | A | 5/1984 | Cappis | |
| 4,544,087 | A | 10/1985 | Modig | |
| 4,627,554 | A | 12/1986 | Leibinsohn | |
| 4,747,527 | A | 5/1988 | Trumpower, II | |
| 4,852,781 | A | 8/1989 | Shurnick et al. | |
| 4,948,023 | A | 8/1990 | Tripp | |
| 5,104,016 | A | 4/1992 | Runkel | |
| 5,228,609 | A | 7/1993 | Gregory | |
| 5,301,858 | A | 4/1994 | Hollander | |
| 5,427,290 | A | 6/1995 | Thatcher | |
| 5,431,308 | A | 7/1995 | Tchen | |
| 5,566,869 | A | 10/1996 | Katz | |
| 5,571,260 | A | 11/1996 | Krug | |
| 5,645,404 | A | 7/1997 | Zelenak | |
| 5,727,720 | A | 3/1998 | Thatcher | |
| 5,938,089 | A | 8/1999 | Abreu-Marston | |
| 5,957,355 | A * | 9/1999 | Swetish | A45F 3/04 224/627 |
| 5,975,387 | A | 11/1999 | Gleason et al. | |
| 6,024,265 | A | 2/2000 | Clements | |
| 6,164,509 | A * | 12/2000 | Gausling | A45F 3/04 224/153 |
| 6,179,187 | B1 | 1/2001 | Lemire et al. | |
| 6,247,619 | B1 | 6/2001 | Gill et al. | |
| 6,286,461 | B1 * | 9/2001 | Martz | A01K 1/0254 119/497 |
| 6,409,048 | B1 | 6/2002 | Belzeski | |
| 6,497,348 | B2 | 12/2002 | Forsman et al. | |
| 6,598,770 | B2 | 7/2003 | Bolts | |
| 6,634,533 | B2 | 10/2003 | Thompson et al. | |
| 6,837,409 | B2 | 1/2005 | Lemanski, II | |
| 7,201,299 | B2 | 4/2007 | Forsman | |
| 7,204,399 | B2 * | 4/2007 | Collier | A45C 7/0077 224/153 |
| 7,938,302 | B2 | 5/2011 | Gibson | |
| 8,172,117 | B2 | 5/2012 | Maggi | |
| 8,181,835 | B2 * | 5/2012 | Thatcher | A45F 3/14 224/627 |
| 8,893,940 | B2 | 11/2014 | Green et al. | |
| 8,955,729 | B2 | 2/2015 | Gleason | |
| 8,998,051 | B2 * | 4/2015 | Demskey | A45C 13/30 224/579 |
| 9,125,478 | B2 * | 9/2015 | Li | A45F 3/047 |
| 9,125,479 | B2 | 9/2015 | Chapuis | |
| 9,439,501 | B2 * | 9/2016 | Demskey | A45F 3/14 |
| 2002/0139821 | A1 * | 10/2002 | Fleischli | B63C 9/087 224/153 |
| 2003/0034372 | A1 | 2/2003 | Thompson et al. | |
| 2003/0121945 | A1 | 7/2003 | Lemanski, II | |
| 2005/0092803 | A1 | 5/2005 | Collier et al. | |
| 2006/0000856 | A1 | 1/2006 | West | |
| 2008/0179364 | A1 * | 7/2008 | Thatcher | A45F 3/14 224/600 |
| 2010/0230458 | A1 | 9/2010 | Kramer | |
| 2011/0036883 | A1 | 2/2011 | Cox | |

OTHER PUBLICATIONS

Patagonia Endurance Pack, https://web.archive.org/web/20060314233845/http:/www.patagonia.com/za/PDC?OPTION=PRODUCT&merchant_rn=7385&sku=48680&ws=false, Mar. 14, 2006.

* cited by examiner

BACKPACKS WITH COOPERATIVELY ADJUSTED HIP BELTS AND COMPRESSION STRAPS

RELATED APPLICATION

This application claims priority under 35 U.S.C. § 119(e) to U.S. Provisional Patent Application No. 62/520,908, which is entitled "BACKPACKS WITH HIP BELTS AND COMPRESSION STRAPS" and was filed on Jun. 16, 2017, the disclosure of which is hereby incorporated by reference.

FIELD

The present disclosure relates generally to the field of backpacks with hip belts and compression straps to stabilize the load of the backpack on a user's body and the cargo within the backpack, and more specifically to backpacks with hip belts and compression straps that are cooperatively adjusted.

BACKGROUND

Backpacks generally are configured to be worn on a user's back via a pair of shoulder straps and to carry a load. Backpacks may be configured to be utilized while engaging in outdoor activities, such as hiking, trekking, running, road cycling, and mountain biking, in which the user's motion may agitate and/or jostle the contents of the backpack. Thus, backpacks configured to be utilized during such activities may include one or more compression straps configured to compress a volume of the backpack to stabilize the load enclosed therein, thereby restricting the contents of the backpack from shifting with respect to each other and with respect to the backpack. Additionally, backpacks configured to be utilized while engaging in outdoor activities may include a pair of hip belts configured to be selectively secured around a user's waist to snugly secure the backpack and its load relative to the user's body to further stabilize the load on the user's back. Such hip belts also may serve to transfer a portion of a weight of the load from the user's shoulders to the user's hips.

Backpacks that include compression straps as well as hip belts generally permit adjustment of a degree of compression produced by the compression straps as well as a fit of the hip belt around the user's waist. Each compression strap and hip belt may include an accompanying adjustment strap, each of which may need to be adjusted independently to achieve the desired fit and degree of compression. For example, a backpack may require a user to adjust each of a pair of compression straps to symmetrically compress a load within the backpack, and to separately adjust each of a pair of hip belts to symmetrically adjust the fit of the backpack around the user's waist, thus requiring independent adjustment of each of a total of four adjustment straps. Additionally, under- or over-compression of the load may render it difficult to properly adjust the hip belt size without needing to revisit the compression adjustment. Hence, adjusting each of the hip belt size and the degree of compression may require an iterative process to optimize both the fit and compression of the backpack, which may be frustrating and/or time-consuming. Furthermore, in some cases, the compression adjustment straps may not be readily accessible to the user when the user wears the backpack, further complicating the fit and compression optimization process. Additionally, in some cases, the presence of several adjustment straps may be cumbersome and/or may introduce a risk of the user inadvertently tightening or releasing the adjustment straps while wearing the backpack and engaging in recreational activities. In some further cases, a backpack may be configured such that the hip belts and compression straps are adjusted simultaneously and by an equal amount, which may result in over and/or under tightening of the hip belt and/or compression of the load and thus preclude both from being independently adjusted to a desired degree. Thus, there exists a need for backpacks with cooperatively adjusted hip belts and compression straps that are simple, easy, and intuitive to adjust.

Backpacks with cooperatively adjusted hip belt segments and compression strap segments are disclosed herein. A backpack includes a pack body that includes at least one storage compartment, at least one shoulder strap operatively coupled to the pack body and configured to at least partially support the backpack upon a user's shoulders when the user wears the backpack, and a belt assembly configured to extend around the user's waist when the user wears the backpack.

The pack body includes a back panel configured to lie adjacent to the user's back when the user wears the backpack and an exterior panel that faces away from the back panel. The exterior panel is at least partially separated from the back panel by a storage compartment of the at least one storage compartment.

The belt assembly includes at least one compression strap segment configured to selectively adjust a pack volume of the pack body; at least one hip belt segment configured to at least partially support the backpack upon the user's hips when the user wears the backpack; at least one adjustment strap interconnecting a corresponding compression strap segment and a corresponding hip belt segment; and a releasable fastener configured to selectively secure the belt assembly around the user's waist when the user wears the backpack. Each compression strap segment includes a compression strap segment pack end that is coupled to the pack body and a compression strap segment adjustment end that is coupled to a corresponding adjustment strap. Each hip belt segment includes a hip belt segment pack end that is coupled to the pack body at a location proximal the back panel relative to a corresponding compression strap segment pack end and a hip belt segment adjustment end that is coupled to a corresponding adjustment strap.

The backpack additionally includes a belt assembly waist loop with a belt assembly waist perimeter, such that the belt assembly waist loop is partially defined by each hip belt segment and a portion of each adjustment strap that extends between the corresponding hip belt segment and the releasable fastener. Each adjustment strap is configured to selectively adjust each of the pack volume and the belt assembly waist perimeter. The belt assembly is configured such that, responsive to the user applying a tension force to the adjustment strap, each of the pack volume and the belt assembly waist perimeter decreases by a respective degree that depends upon a ratio of the force required to decrease the pack volume to the force required to decrease the belt assembly waist perimeter.

DETAILED DESCRIPTION

FIGS. 1-13 provide examples of backpacks 100 according to the present disclosure. Elements that serve a similar, or at least substantially similar, purpose are labeled with like numbers in each of FIGS. 1-13, and these elements may not be discussed in detail herein with reference to each of FIGS. 1-13. Similarly, all elements may not be labeled in each of FIGS. 1-13, but reference numbers associated therewith may be utilized herein for consistency. Elements, components, and/or features that are discussed herein with reference to one or more of FIGS. 1-13 may be included in and/or utilized with the subject matter of any of FIGS. 1-13 without departing from the scope of the present disclosure.

In general, elements that are likely to be included in a given (i.e., a particular) embodiment are illustrated in solid lines, while elements that are optional to a given embodiment are illustrated in dash-dot lines. However, elements that are shown in solid lines are not essential to all embodiments, and an element shown in solid lines may be omitted from a given embodiment without departing from the scope of the present disclosure.

Figure 1:
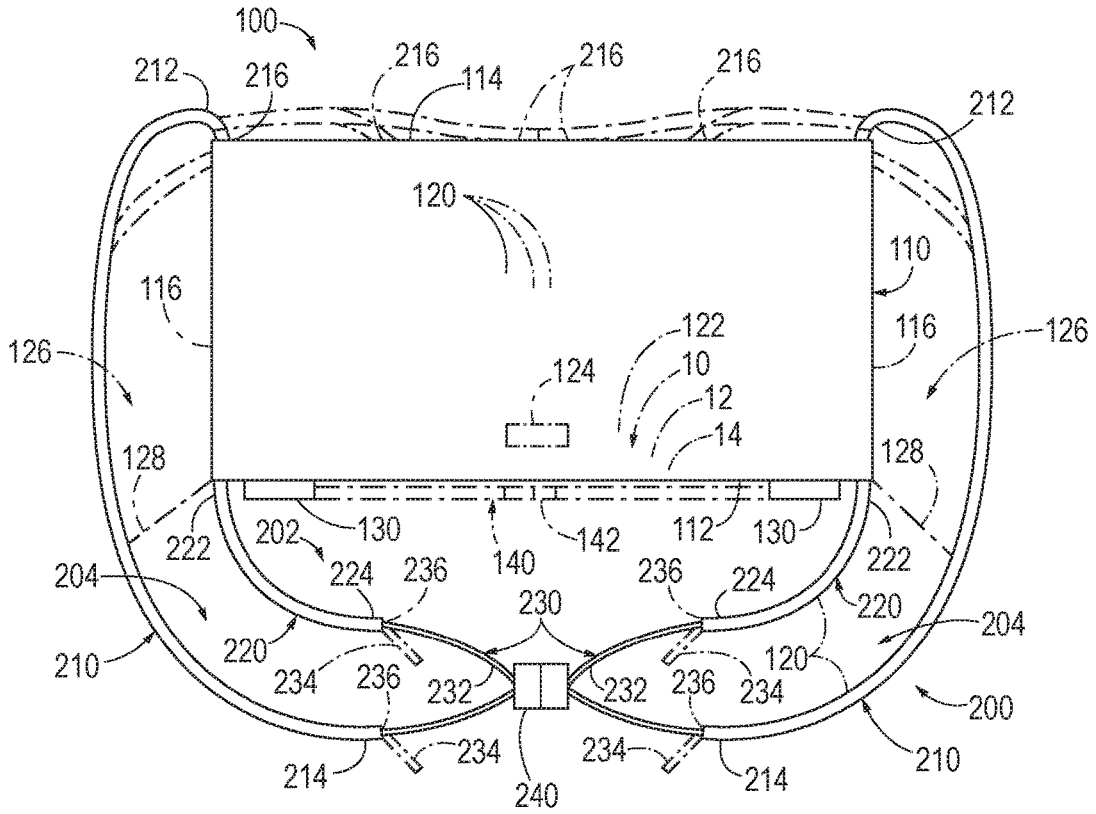
FIG. 1 is a schematic top plan view representing examples of backpacks according to the present disclosure.
Figure 2:
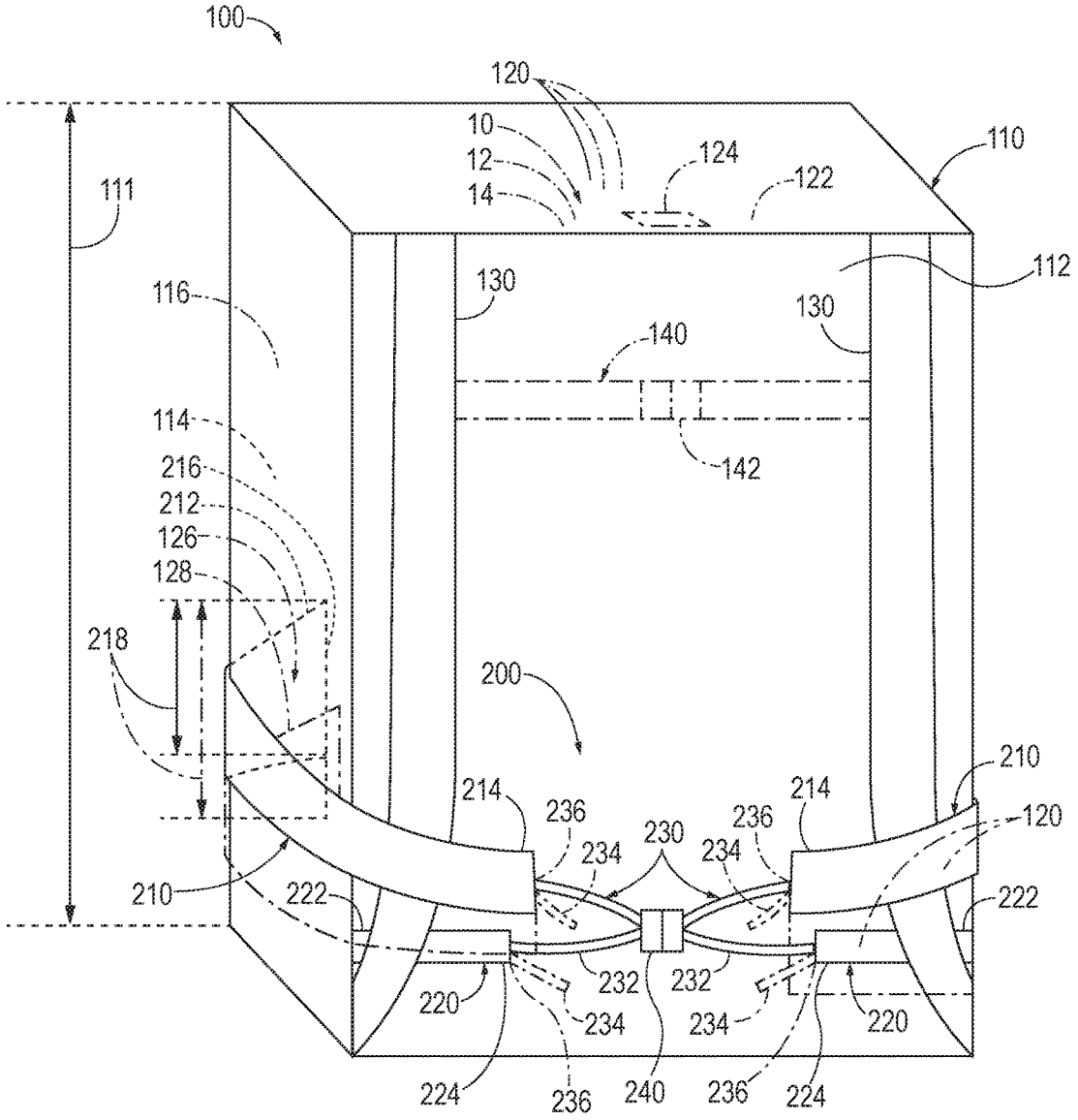
FIG. 2 is a schematic front perspective view representing examples of backpacks according to the present disclosure.

As schematically illustrated in FIGS. 1-2, a backpack 100 includes a pack body 110 that includes at least one storage compartment 120, at least one shoulder strap 130 operatively coupled to the pack body and configured to at least partially support the backpack upon a user's shoulders when the user wears the backpack, and a belt assembly 200 coupled to the pack body and configured to extend around the user's hips and/or waist when the user wears the backpack. Belt assembly 200 also is configured to selectively compress pack body 110, such as to selectively reduce a volume thereof. As discussed herein, belt assembly 200 is configured such that each of a fit of the belt assembly around the user's waist and the degree of compression of pack body 110 may be adjusted concurrently and to variable respective degrees.

Belt assembly 200 includes at least one compression strap segment 210 configured to selectively compress pack body 110 by selectively adjusting a pack volume of the pack body. Belt assembly 200 additionally includes at least one hip belt segment 220 configured to at least partially support backpack 100 upon the user's hips when the user wears backpack 100. Belt assembly 200 further includes a releasable fastener 240 configured to be selectively coupled and uncoupled to selectively secure the belt assembly around the user's waist when the user wears the backpack. Compression strap segment 210 may include and/or be any appropriate component of belt assembly 200, such as a portion of a more extensive compression strap assembly that is at least partially integrated into pack body 110. In such an embodiment, each compression strap segment 210 also may be referred to as a compression strap portion 210. Alternatively, compression strap segment 210 may refer to a stand-alone component that extends from pack body 110. In such an embodiment, each compression strap segment 210 also may be referred to as a compression strap 210. Similarly, each hip belt segment 220 may include and/or be any appropriate component of belt assembly 200, such as a portion of a more extensive hip belt assembly that is at least partially integrated into pack body 110. In such an embodiment, each hip belt segment 220 also may be referred to as a hip belt portion 220. Alternatively, each hip belt segment 220 may refer to a stand-alone component that extends from pack body 110. In such an embodiment, each hip belt segment 220 also may be referred to as a hip belt 220.

While each compression strap segment 210 primarily is configured to compress pack body 110, it is additionally within the scope of the present disclosure that each compression strap segment also may at least partially support backpack 100 upon the user's hips, such as by compressing a corresponding hip belt segment 220 around the user's waist when the user wears the backpack. Similarly, while each hip belt segment 220 primarily is configured to at least partially support backpack 100 upon the user's hips, it is additionally within the scope of the present disclosure that each hip belt segment also may at least partially compress pack body 110, such as by providing a compressive force between a portion of the pack body and the user's back.

As additionally schematically illustrated in FIGS. 1-2, backpack 100 further may include a sternum strap 140 extending between the pair of shoulder straps 130 and configured to extend across the user's chest when the user wears the backpack. Sternum strap 140 may be selectively fastened around the user's chest and selectively adjusted to maintain the pair of shoulder straps 130 in position relative to the user's chest, such as to maintain the shoulder straps on the user's shoulders and/or to reduce a strain on the user's shoulders. For example, and as schematically illustrated in FIGS. 1-2, sternum strap 140 may include a sternum strap fastener 142 configured to be selectively coupled and uncoupled to selectively secure the sternum strap around the user's chest.

Each storage compartment 120 may be configured to carry objects therein, such as may be utilized in such sports or activities as hiking, backpacking, mountain biking, running, etc. As examples, each storage compartment 120 may be configured to carry food, water, clothing, camping equipment, and/or sport equipment. As a more specific example, and as schematically illustrated in FIGS. 1-2, at least one storage compartment 120 may include and/or be a hydration bladder compartment 122 configured to hold at least a portion of a hydration system 10, such as a hydration bladder 12. Pack body 110 further may include at least one hydration tube passage 124 configured to permit a drink tube 14 that is fluidly coupled to hydration bladder 12 to extend out of hydration bladder compartment 122. Stated differently, hydration system 10 may include drink tube 14 that extends from and is fluidly coupled to hydration bladder 12, and hydration tube passage 124 may be configured to permit the hydration tube to pass therethrough such that the user may drink from hydration bladder 12 without opening hydration bladder compartment 122. Although not required to all embodiments, hydration tube passage 124 may be a localized passage having a fixed opening size, such as that is slightly (e.g., 0-50%) larger than the cross-sectional area of a hydration tube that extends through the passage.

Each storage compartment 120 may be configured to be selectively opened and closed via a mechanical closure, such as a zipper. As discussed, pack body 110 may include and/or define at least one storage compartment 120. Additionally or alternatively, and as schematically illustrated in FIGS. 1-2, each compression strap segment 210 and/or hip belt segment 220 may include and/or define storage compartment 120. In such an embodiment, such a storage compartment 120 also may be referred to as a belt assembly storage compartment 120. Storage compartment(s) 120 of backpack 100 collectively may have and/or define any appropriate maximum total (e.g., uncompressed) capacity. As examples, the pack volume and/or the maximum total capacity of storage compartment(s) 120 may be at least 10 liters (L), at least 20 L, at least 30 L, at least 40 L, at least 50 L, at least 60 L, at most 75 L, at most 55 L, at most 45 L, at most 35 L, at most 25 L, and/or at most 15 L.

With continued reference to FIGS. 1-2, pack body 110 includes a back panel 112 configured to lie adjacent to the user's back when the user wears backpack 100. Pack body 110 also includes an exterior panel 114 that faces away from the back panel and is at least partially separated from the back panel by at least one storage compartment 120. Pack body 110 additionally may include at least one side panel 116 positioned between back panel 112 and exterior panel 114. Each of back panel 112, exterior panel 114, and/or side panel(s) 116 may be at least substantially formed of a single (e.g., unitary) component, or may include a plurality of distinct components coupled to one another. Additionally or alternatively, two or more of back panel 112, exterior panel 114, and (when present) side panel(s) 116 may refer to respective components, portions, and/or regions of a single (e.g., unitary) structure. In such embodiments, back panel 112, exterior panel 114, and/or side panel 116 also may be referred to as panel portions and/or panel regions of pack body 110.

In some embodiments, and as schematically illustrated in FIGS. 1-2, pack body 110 additionally may include at least one inner side pocket 126 positioned between compression strap segment 210 and pack body 110. As an example, inner side pocket 126 may be defined by compression strap segment 210, a side pocket panel 128 that extends between the compression strap segment and a portion of pack body 110 proximal back panel 112 relative to compression strap segment pack end 212 of the compression strap segment, and a portion of the pack body (such as a portion of side panel 116) that extends between the compression strap segment and the side pocket panel. As additional examples, side pocket panel 128 may be an elastomeric side pocket panel and/or a mesh side pocket panel.

Belt assembly 200 further includes at least one adjustment strap 230 interconnecting a corresponding compression strap segment 210 and a corresponding hip belt segment 220. More specifically, each adjustment strap 230 is slidingly coupled to releasable fastener 240 such that the releasable fastener is selectively positioned along the adjustment strap between a corresponding compression strap segment 210 and a corresponding hip belt segment 220 and such that the releasable fastener may translate along at least a portion of a length of the adjustment strap. Releasable fastener 240 may be configured to slide freely along each adjustment strap 230. Each adjustment strap 230 is configured to selectively adjust each of the pack volume and a belt assembly waist perimeter of a belt assembly waist loop 202 partially defined by each hip belt segment 220 and a portion of each adjustment strap that extends between a corresponding hip belt segment and the releasable fastener. Stated differently, each adjustment strap 230 is configured to selectively adjust both the fit (e.g., tightness) of belt assembly 200 around the user's waist and the degree of compression imparted on pack body 110 by compression strap segments 210. More specifically, and as discussed herein, belt assembly 200 is configured such that each adjustment strap 230 adjusts the fit of the belt assembly around the user's waist and the degree of compression imparted on pack body 110 concurrently and to variable relative degrees depending upon the relative forces required to produce the respective adjustments.

FIGS. 1-5 and 8-13 illustrate embodiments of backpack 100 in which the at least one shoulder strap 130 consists of two shoulder straps, the at least one compression strap segment 210 consists of two compression strap segments, the at least one hip belt segment 220 consists of two hip belt segments, and the at least one adjustment strap 230 consists of two adjustment straps. In such an embodiment, backpack 100 may be described as having a left shoulder strap 130 and a right shoulder strap 130; a left compression strap segment 210 and a right compression strap segment 210; a left hip belt segment 220 and a right hip belt segment 220; and/or a left adjustment strap 230 and a right adjustment strap 230. Following this description, left compression strap segment 210, left hip belt segment 220, and left adjustment strap 230 may be described as being associated with one another and/or as corresponding to one another. Similarly, right compression strap segment 210, right hip belt segment 220, and right adjustment strap 230 may be described as being associated with one another and/or as corresponding to one another.

As used herein, positional terms such as "left," "right," "top," "bottom," and the like are considered from the perspective of a user wearing backpack 100. While the following discussion generally is directed to such embodiments, this is not required to all backpacks 100 according to the present disclosure, and it is additionally within the scope of the present disclosure that backpack 100 and/or belt assembly 200 may include any appropriate numbers of shoulder straps 130, compression strap segments 210, hip belt segments 220, and adjustment straps 230, such as one, two, three, or more than three of each component.

As schematically illustrated in FIGS. 1-2, each compression strap segment 210 includes a compression strap segment pack end 212 coupled to pack body 110 and a compression strap segment adjustment end 214 coupled to a corresponding adjustment strap 230. Similarly, each hip belt segment 220 includes a hip belt segment pack end 222 coupled to pack body 110 and a hip belt segment adjustment end 224 coupled to a corresponding adjustment strap 230. In this manner, each compression strap segment 210 is operatively coupled to a corresponding hip belt segment 220 via a corresponding adjustment strap 230. More specifically, backpack 100 may be described as having left compression strap segment 210 operatively coupled to left hip belt segment 220 via left adjustment strap 230 and/or as having right compression strap segment 210 operatively coupled to right hip belt segment 220 via right adjustment strap 230. Additionally, in such an embodiment, belt assembly waist loop 202 may be defined by each hip belt segment 220 of the pair of hip belt segments, releasable fastener 240, a portion of each adjustment strap 230 of the pair of adjustment straps that extends between the corresponding hip belt segment and the releasable fastener, and a portion of pack body 110 that extends between the respective hip belt segment pack ends 222 of the pair of hip belt segments.

Each compression strap segment adjustment end 214 may be operatively coupled to the corresponding hip belt segment adjustment end 224 only via the corresponding adjustment strap 230. For example, each compression strap segment adjustment end 214 may not be directly and/or fixedly coupled to the corresponding hip belt segment adjustment end 224. Such a configuration may facilitate adjusting belt assembly 200 through a wider range of possible arrangements (such as degrees of tightness around the user's waist and/or degrees of compression imparted on pack body 110) relative to a configuration in which each compression strap segment adjustment end 214 is fixedly coupled to the corresponding hip belt segment adjustment end 224. For example, in such a configuration, each adjustment strap 230 may at least partially define and/or adjustably vary a separation between each corresponding compression strap segment adjustment end 214 and hip belt segment adjustment end 224. Such a configuration thus may facilitate independent adjustment of the fit of belt assembly 200 around the user's waist and the degree of compression imparted on pack body 110 by compression strap segments 210.

As used herein, the term "fixedly coupled," as used to describe an arrangement and/or configuration of two or more components, refers to an arrangement and/or configuration in which the components are coupled, attached, and/or otherwise joined together such that the components are fixed in relation to one another during operative use of backpacks 100. As examples, two components may be described as being fixedly coupled to one another when the components are joined via sewing, via a buckle (such as a non-adjustable buckle), via a ring, etc. Thus, for example, two components may be described as being fixedly coupled to one another even when the components are spaced-apart from one another, such as via a non-adjustable buckle. As used herein, two or more components that are described as being fixedly coupled to one another additionally or alternatively may be described as being non-adjustably coupled to one another.

Belt assembly 200 may be coupled to pack body 110 in any appropriate manner. For example, each compression strap segment pack end 212 and/or each hip belt segment pack end 222 may be fixedly coupled to pack body 110. In general, each hip belt segment pack end 222 is coupled to pack body 110 at a location proximal back panel 112 relative to the corresponding compression strap segment pack end 212. For example, and as schematically illustrated in FIGS. 1-2, each hip belt segment pack end 222 may be coupled to back panel 112, and/or each compression strap segment pack end 212 may be coupled to pack body 110 at a compression strap segment attachment region 216 that is spaced apart from the hip belt segment pack end. Specifically, compression strap segment attachment region 216 may be sufficiently spaced apart from the corresponding hip belt segment pack end 222 and/or back panel 112 that urging each compression strap segment 210 toward the back panel serves to compress pack body 110 and/or to draw exterior panel 114 toward the back panel. As an example, in an embodiment in which pack body 110 includes at least one side panel 116, compression strap segment attachment region 216 may not be located on side panel 116. More specifically, and as illustrated in dash-dot lines in FIG. 1, exterior panel 114 may include compression strap segment attachment region 216 at a location that is spaced apart from side panel 116. However, this is not required to all examples of backpack 100 that include side panel 116, and it is additionally within the scope of the present disclosure that compression strap segment attachment region 216 may be positioned on and/or adjacent to the side panel.

Compression strap segment attachment region 216 may be configured to distribute a compression force exerted by compression strap segment 210 across an extent of the exterior panel sufficient to produce a substantially uniform compression of pack body 110. As more specific examples, and as schematically illustrated in FIG. 2, pack body 110 may be characterized by a pack body height 111, and each compression strap segment attachment region 216 may have a compression strap segment attachment region height 218 that is at least 10%, at least 20%, at least 30%, at least 40%, and/or at least 50% of the pack body height.

Each adjustment strap 230 may be coupled to the corresponding compression strap segment 210 and the corresponding hip belt segment 220 in any appropriate manner such that the adjustment strap serves to selectively adjust each of the pack volume and the belt assembly waist perimeter. For example, and as illustrated in FIGS. 1-2, each adjustment strap 230 may be adjustably coupled to at least one of the corresponding compression strap segment 210 and the corresponding hip belt segment 220 via an adjustable buckle 236 such that the adjustment strap may selectively slide through the adjustable buckle. As an example, each adjustable buckle 236 may be adjustably coupled to the corresponding adjustment strap 230 and non-adjustably coupled to the corresponding compression strap segment 210. As another example, each adjustable buckle 236 may be adjustably coupled to the corresponding adjustments strap 230 and non-adjustably coupled to the corresponding hip belt segment 220. As an example, in a configuration in which adjustable buckle 236 is fixedly coupled to compression strap segment 210, the adjustable buckle may not be configured to slide relative to compression strap segment adjustment end 214 of the compression strap segment during adjustment of belt assembly 200 while backpack 100 is worn by the user. Adjustable buckle 236 additionally or alternatively may be referred to as an adjustment buckle 236.

Adjustable buckle 236 may include and/or be any appropriate buckle configured to permit adjustment strap 230 to selectively translate therethrough while restricting unintentional translation of the adjustment strap relative to the adjustment buckle. For example, adjustable buckle 236 may include and/or be a ladder-lock buckle. Each adjustment strap 230 may be fixedly coupled to the corresponding hip belt segment 220, and each adjustment strap 230 may be adjustably coupled to the corresponding compression strap segment 210 via adjustable buckle 236. Alternatively, each adjustment strap 230 may be fixedly coupled to the corresponding compression strap segment 210, and each adjustment strap 230 may be adjustably coupled to the corresponding hip belt segment 220 via adjustable buckle 236. As yet another example, and as schematically illustrated in FIGS. 1-2, each adjustment strap 230 may be adjustably coupled to each of the corresponding compression strap segment 210 and the corresponding hip belt segment 220 via respective adjustable buckles 236.

As schematically illustrated in FIG. 2, compression strap segments 210 and hip belt segments 220 may have a variety of relative orientations. For example, and as illustrated in solid lines in FIG. 2, belt assembly 200 may be configured such that each compression strap segment 210 is generally vertically spaced apart from the corresponding hip belt segment 220 when belt assembly 200 extends around the user's waist. Alternatively, and as illustrated in dash-dot lines in FIG. 2, each compression strap segment 210 may at least partially overlap the corresponding hip belt segment 220 (as illustrated on the left-hand side of FIG. 2), and/or may fully overlap the corresponding hip belt segment (as illustrated on the right-hand side of FIG. 2), when belt assembly 200 extends around the user's waist. Additionally or alternatively, each compression strap segment 210 may be wider, as measured in a vertical direction, than each hip belt segment 220 for a majority, approximately all, or all of the compression strap segment's length. In such an embodiment, each compression strap segment 210 also may be referred to as a compression wing 210.

As schematically illustrated in FIGS. 1-2, each adjustment strap 230 may be described as including a loop portion 232 and at least one free end 234. Specifically, loop portion 232 extends between compression strap segment adjustment end 214 of the corresponding compression strap segment 210 and hip belt segment adjustment end 224 of the corresponding hip belt segment 220. Each free end 234 extends from the loop portion at the compression strap segment adjustment end or the hip belt segment adjustment end. Additionally, each adjustment strap 230 may be described as adjusting a belt assembly internal loop perimeter of a corresponding belt assembly internal loop 204 at least partially defined by the corresponding compression strap segment 210, the corresponding hip belt segment 220, the loop portion 232 of the corresponding adjustment strap 230, and a portion of pack body 110 that extends between compression strap segment pack end 212 of the corresponding compression strap segment and hip belt segment pack end 222 of the corresponding hip belt segment. Belt assembly internal loop 204 additionally may be described as including portions of coupling structures, such as buckles and fasteners, that interconnect other components of the belt assembly internal loop. For example, belt assembly internal loop 204 additionally may be described as including a portion of releasable fastener 240 that interconnects compression strap segment 210 and adjustment strap 230 and/or a portion of the releasable fastener that interconnects hip belt segment 220 and the adjustable strap.

Each free end 234 is configured to be pulled by the user to selectively decrease the belt assembly internal loop perimeter of the corresponding belt assembly internal loop 204, thereby decreasing the pack volume and/or the belt assembly waist perimeter. More specifically, when the user pulls free end 234 of each adjustment strap 230 away from the corresponding adjustable buckle 236, the free end increases in length and loop portion 232 correspondingly decreases in length. In this manner, pulling on free end 234 of each adjustment strap 230 decreases the belt assembly waist perimeter and/or the belt assembly internal loop perimeter such that belt assembly 200 is tightened around the user's waist and/or such that the pack volume is decreased. Similarly, to increase the pack volume and/or the belt assembly waist perimeter, the user may release a tension of adjustment strap 230 (such as by manipulating the corresponding adjustable buckle 236) to decrease the length of free end 234 and increase the length of loop portion 232, thereby increasing the belt assembly waist perimeter and/or the belt assembly internal loop perimeter. In general, each adjustment strap 230 is configured such that a sum of the length of each corresponding loop portion 232 and the length of the corresponding free end(s) 234 remains constant as the free end is pulled and/or released.

Operatively coupling each hip belt segment 220 to a corresponding compression strap segment 210 via a corresponding adjustment strap 230 additionally may produce a mechanical advantage for tightening the hip belt segment around the user's waist and/or for compressing pack body 110 with the compression strap segment. For example, in an embodiment in which adjustment strap 230 operatively couples a corresponding hip belt segment 220 to a corresponding compression strap segment 210 via releasable fastener 240 and in which free end 234 extends from adjustable buckle 236, the releasable fastener and/or the adjustable buckle may operate as a pulley. That is, in such an embodiment, when the user exerts a tension force on the free end 234 of an adjustment strap 230, the corresponding compression strap segment adjustment end 214 and/or the corresponding hip belt segment adjustment end 224 may be urged toward releasable fastener 240 with a force that is greater than the tension force exerted on the free end by the user.

Belt assembly 200 generally is configured such that, when the user pulls free end 234 of each adjustment strap 230 away from the corresponding adjustable buckle 236, the belt assembly waist perimeter and the belt assembly internal loop perimeter may decrease concurrently and by variable respective degrees. For example, when the user pulls free end 234 of each adjustment strap 230 away from the corresponding adjustable buckle 236, the belt assembly waist perimeter may be decreased by a greater extent than the belt assembly internal loop perimeter is decreased if pulling the corresponding hip belt segment adjustment end 224 toward releasable fastener 240 requires less force than pulling the corresponding compression strap segment adjustment end 214 toward the releasable fastener. Similarly, when the user pulls free end 234 of each adjustment strap 230 away from the corresponding adjustable buckle 236, the belt assembly internal loop perimeter may be decreased by a greater extent than the belt assembly waist perimeter is decreased if pulling the corresponding hip belt segment adjustment end 224 toward releasable fastener 240 requires more force than pulling the corresponding compression strap segment adjustment end 214 toward the releasable fastener. More specifically, a ratio of an extent to which the belt assembly waist perimeter is decreased to an extent to which the belt assembly internal loop perimeter is decreased may be proportional to a ratio of a force required to pull the corresponding hip belt segment adjustment end 224 toward releasable fastener 240 to a force required to pull the corresponding compression strap segment adjustment end 214 toward the releasable fastener.

Figure 3:
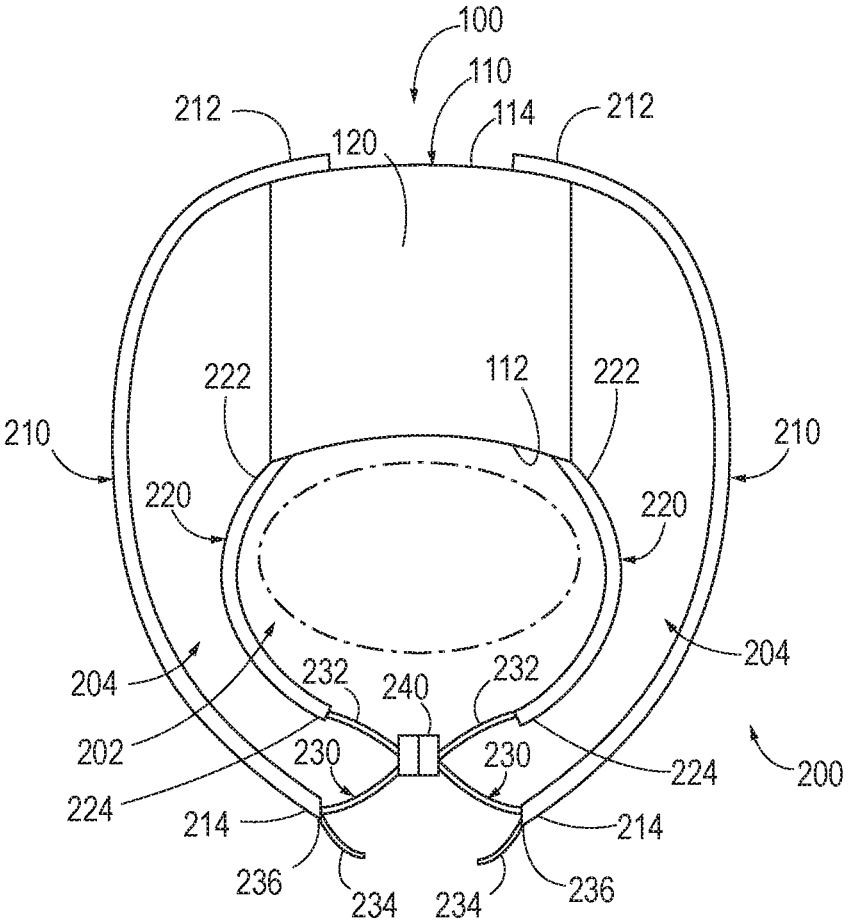
FIG. 3 is a schematic top plan view representing an example of a backpack according to the present disclosure with a belt assembly loosely enclosing a user's waist and with a storage compartment holding an uncompressed load according to the present disclosure.
Figure 4:
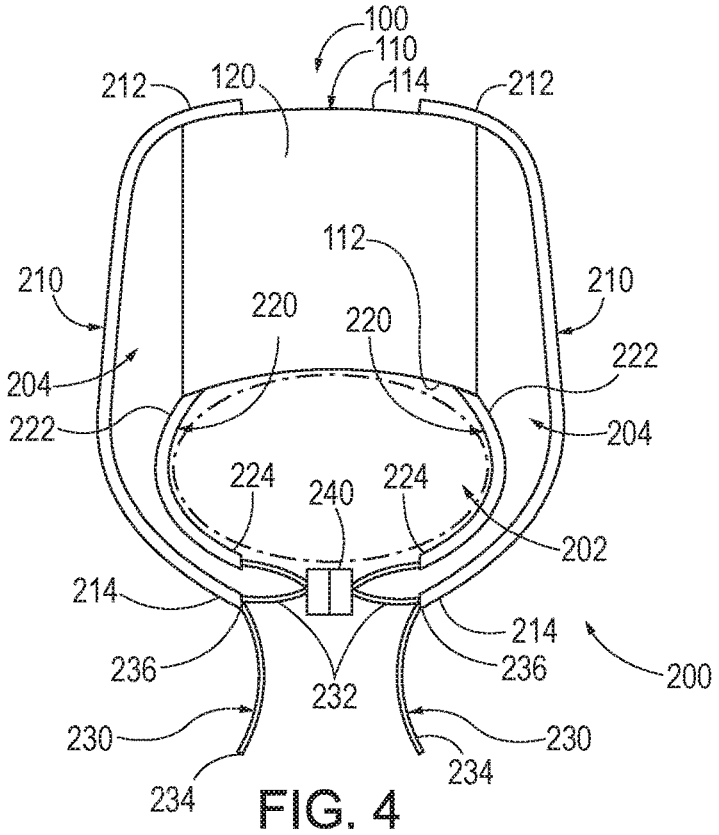
FIG. 4 is a schematic top plan view representing the backpack of FIG. 3 with a hip belt segment of the belt assembly snugly enclosing the user's waist and with the storage compartment holding the uncompressed load.
Figure 5:
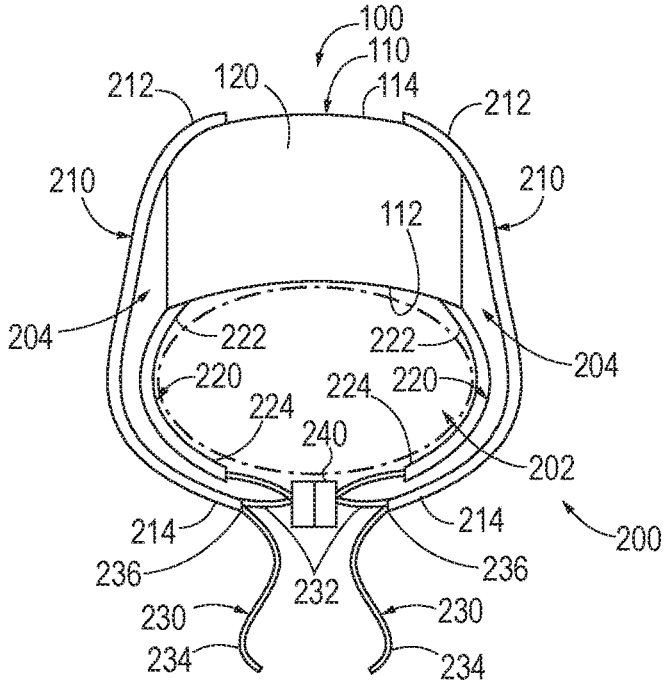
FIG. 5 is a schematic top plan view representing the backpack of FIG. 3 with the hip belt segment snugly enclosing the user's waist and with the storage compartment holding a compressed load.

FIGS. 3-5 schematically illustrate an example of the effect of the user applying tension to either or both of the pair of adjustment straps 230. Specifically, FIGS. 3-5 illustrate backpack 100 with belt assembly 200 extending around a user's waist (represented in dash-dot lines) and with each adjustment strap 230 being fixedly coupled to the corresponding compression strap segment 210 and adjustably coupled to the corresponding hip belt segment 220 via a corresponding adjustable buckle 236.

FIG. 3 schematically illustrates backpack 100 with belt assembly 200 loosely extending around the user's waist and with storage compartment 120 containing a compressible load, while FIGS. 4-5 schematically illustrate a progression of configurations of backpack 100 as the belt assembly is progressively tightened. As discussed, when the user pulls on the free end 234 of either adjustment strap 230 away from the corresponding adjustable buckle 236, the length of loop portion 232 of the adjustment strap and the perimeter of the belt assembly internal loop decrease by equal amounts, thereby compressing pack body 110 (i.e., decreasing the pack volume) and/or tightening belt assembly 200 around the user's waist (i.e., decreasing the belt assembly waist perimeter). The relative degrees to which the pack volume and the belt assembly internal loop perimeter decrease may depend upon a relative resistance offered by distinct components of belt assembly 200. For example, if hip belt segment adjustment end 224 of hip belt segment 220 may be drawn toward releasable fastener 240 with less resistance than would be necessary to draw the corresponding compression strap segment adjustment end 214 toward the releasable fastener, the primary effect of pulling free end 234 of the corresponding adjustment strap 230 away from the corresponding adjustable buckle 236 may be to decrease the belt assembly waist perimeter, thereby tightening belt assembly 200 around the user's waist. This may be the case, for example, if the load within storage compartment 120 is substantially incompressible. Such a scenario is schematically illustrated in FIG. 4, which illustrates a case in which belt assembly 200 has been tightened around the user's waist without substantially compressing pack body 110 and/or the contents thereof.

Alternatively, if compression strap segment adjustment end 214 may be drawn toward releasable fastener 240 with less resistance than would be necessary to draw the hip belt segment adjustment end 224 of the corresponding hip belt segment 220 toward the releasable fastener, the primary effect of pulling free end 234 of the corresponding adjustment strap 230 away from the corresponding adjustable buckle 236 may be to decrease the pack volume, thereby compressing pack body 110. This may be the case, for example, if belt assembly 200 is sufficiently tight around the user's waist that a force required to compress pack body 110 is smaller than the force required to further tighten the belt assembly around the user's waist (which may be less compressible than the pack body). Such a scenario is schematically illustrated in FIG. 5, which illustrates an example in which belt assembly 200 is tightly secured around the user's waist and the pack volume of pack body 110 has been decreased (i.e., compressed). Stated differently, FIG. 5 may be described as schematically illustrating the result of continuing to pull each free end 234 of FIG. 4 away from the corresponding adjustable buckle 236 in an embodiment in which the user's waist is significantly less compressible than the pack body.

Belt assembly 200 additionally or alternatively may be configured such that pulling free end 234 of adjustment strap 230 away from the corresponding adjustable buckle 236 results in the belt assembly waist perimeter decreasing and the pack volume decreasing substantially simultaneously. For example, belt assembly 200 may be configured such that pulling free end 234 of adjustment strap 230 away from the corresponding adjustable buckle 236 brings the belt assembly from the configuration schematically illustrated in FIG. 3 (i.e., with the belt assembly loosely extending around the user's waist and with pack body 110 uncompressed) to the configuration schematically illustrated in FIG. 5 (i.e., with the belt assembly tightly extending around the user's waist and with pack body 110 compressed) without having reached a distinct intermediate configuration such as the configuration schematically illustrated in FIG. 4, in which the belt assembly tightly extends around the user's waist and pack body 110 is uncompressed. Stated differently, belt assembly 200 may be configured such that pulling on free end 234 of either adjustment strap 230 away from the corresponding adjustable buckle 236 simultaneously reduces the belt assembly waist perimeter and the pack volume until one of the belt assembly waist perimeter and the pack volume is restricted from decreasing further, and subsequently reduces the other of the belt assembly waist perimeter and the pack volume until both the belt assembly waist perimeter and the pack volume are restricted from decreasing further.

While the adjustment of the belt assembly waist perimeter and the pack volume may occur simultaneously and/or concurrently, the relative degrees and/or rates at which the belt assembly waist perimeter and the pack volume are decreased may be different. Stated differently, in an example in which pulling each free end 234 of each adjustment strap 230 results in the belt assembly waist perimeter and the pack volume decreasing concurrently, a rate at which the belt assembly waist perimeter decreases may be different than a rate at which each belt assembly internal loop perimeter decreases while each free end is pulled. As discussed, this may be described as resulting from the relative resistance offered to respectively decrease the belt assembly waist perimeter and the pack volume. Additionally or alternatively, this may be described as resulting from the relative forces required to urge compression strap segment adjustment end 214 toward releasable fastener 240 and to urge hip belt segment adjustment end 224 toward the releasable fastener. In some uses, the belt assembly waist perimeter may be decreased more (e.g., by a greater percentage and/or at a greater rate) than the pack volume for a given tension force applied to free end 234 of adjustment strap 230 and/or for a given lengthening of the free end. In other uses, the opposite may be true, namely, the belt waist perimeter may be decreased less (e.g., by a lesser percentage and/or a lesser rate) than the pack volume for a given tension force applied to free end 234 of adjustment strap 230 and/or for a given lengthening of the free end.

Figure 7:
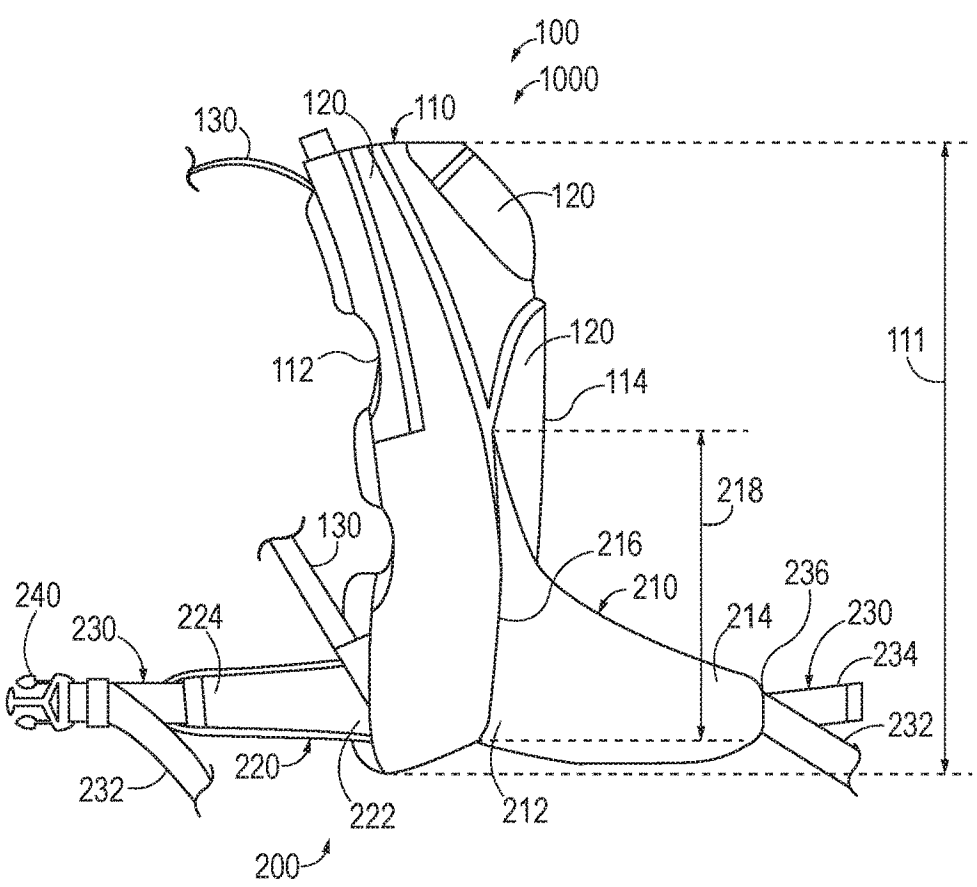
FIG. 7 is a fragmentary side elevation view of the backpack of FIG. 6 with a compression strap segment spaced apart from a hip belt segment.
Figure 6:
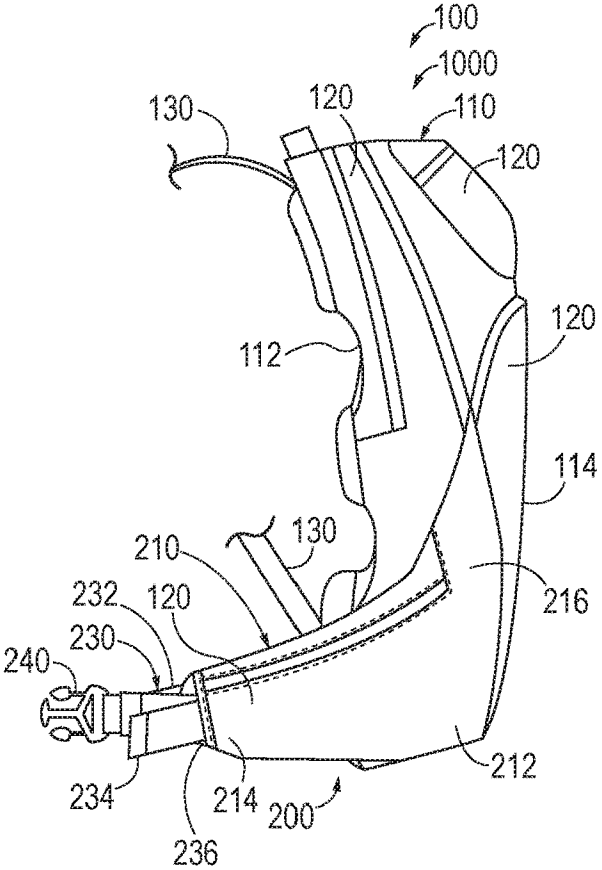
FIG. 6 is a fragmentary side elevation view representing an example of a backpack according to the present disclosure.
Figure 8:
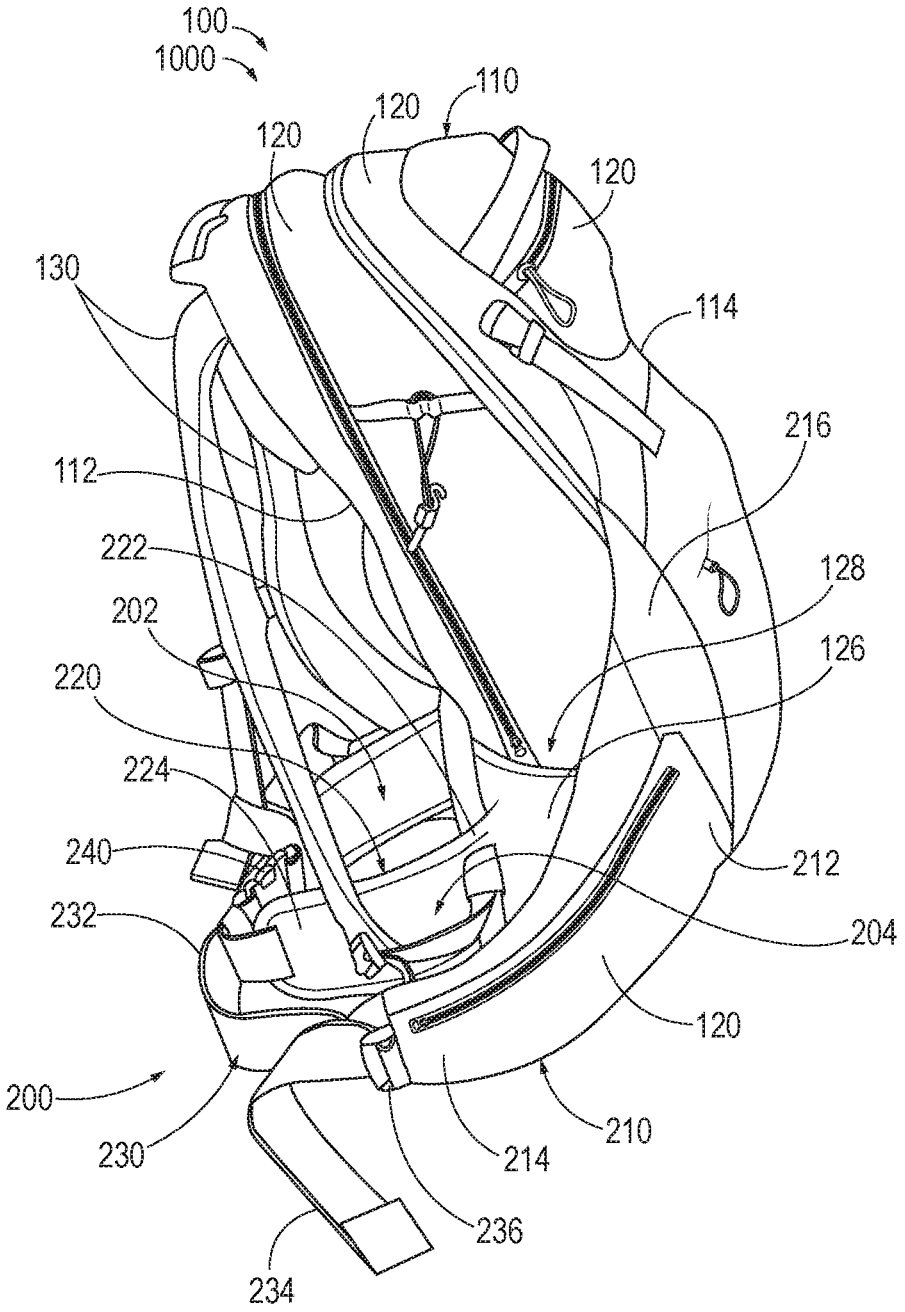
FIG. 8 is a side perspective view representing an example of a backpack according to the present disclosure.
Figure 9:
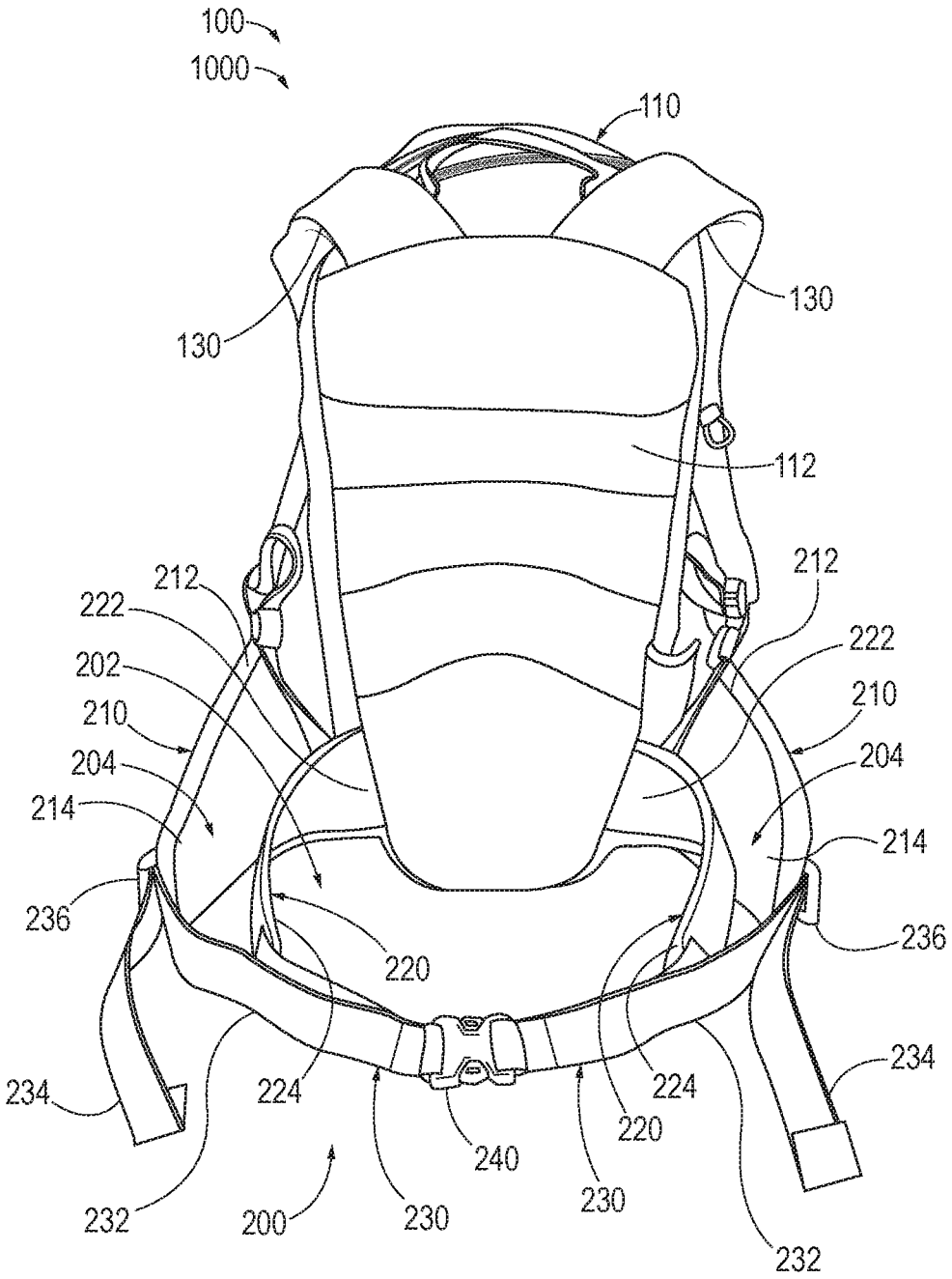
FIG. 9 is a rear perspective view of the backpack of FIG. 8.

FIGS. 6-9 illustrate a backpack 1000, which is an example of backpack 100 according to the present disclosure. More specifically, FIGS. 6-7 provide simplified representations of backpack 1000, while FIGS. 8-9 provide more detailed representations of the backpack. As illustrated in FIGS. 6-9, pack body 110 of backpack 1000 includes three storage compartments 120, and compression strap segment 210 includes an additional storage compartment 120 (illustrated in FIGS. 6 and 8). As best illustrated in FIGS. 8-9, backpack 1000 includes belt assembly 200 in which hip belt segment adjustment end 224 of hip belt segment 220 is fixedly coupled to adjustment strap 230 and in which compression strap segment adjustment end 214 of compression strap segment 210 is adjustably coupled to the adjustment strap via adjustable buckle 236 in the form of a ladder-lock buckle. As best illustrated in FIG. 7, compression strap segment 210 is coupled to exterior panel 114 at compression strap segment attachment region 216 with compression strap segment attachment region height 218 that extends along approximately 50% of pack body height 111 of pack body 110.

Figure 10:
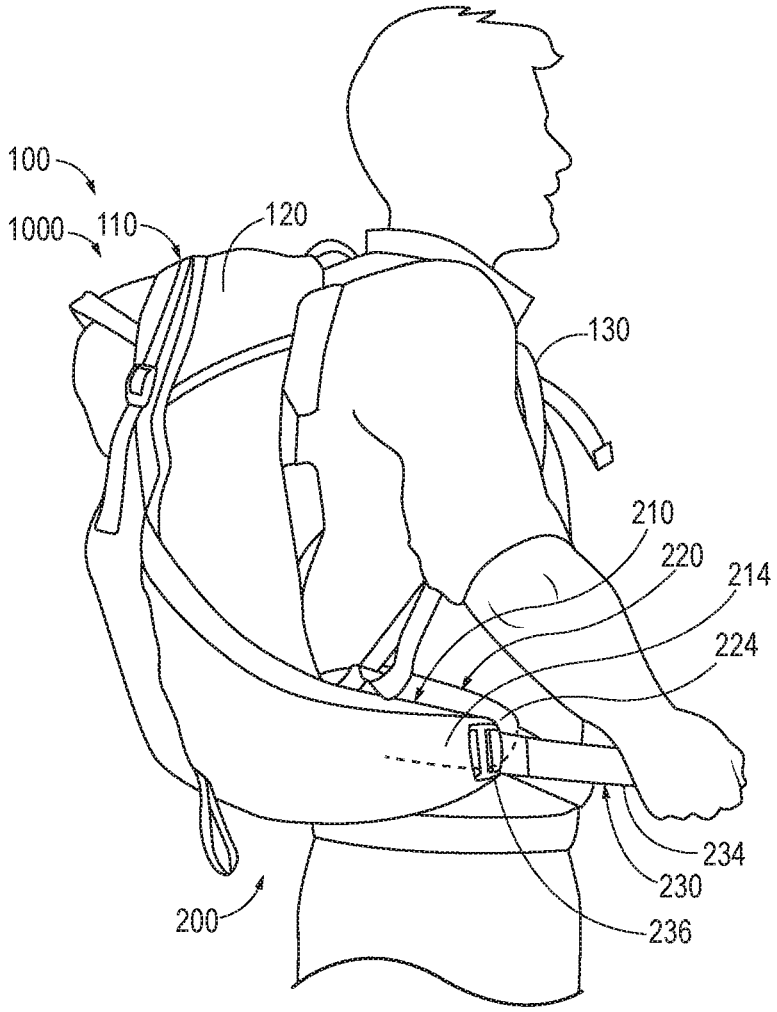
FIG. 10 is a side elevation view of the backpack of FIG. 8 being worn by a user with a belt assembly loosely enclosing the user's waist and with a storage compartment holding an uncompressed load.
Figure 11:
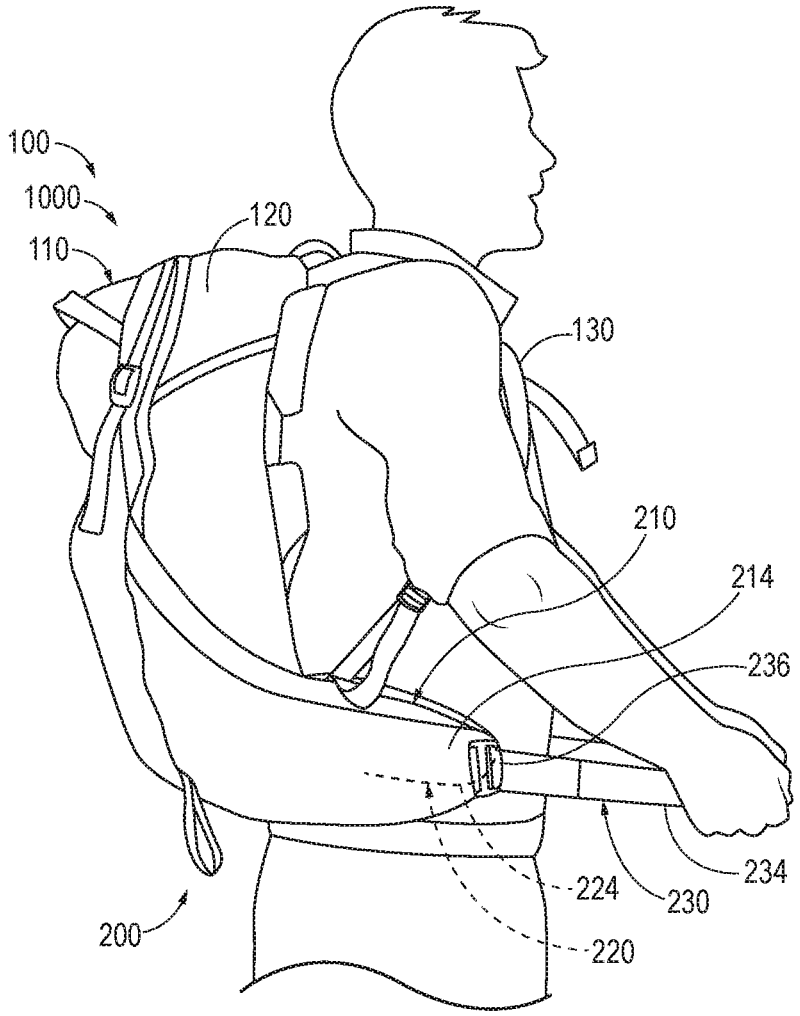
FIG. 11 is a side elevation view of the backpack and the user of FIG. 10 with a hip belt segment of the belt assembly snugly enclosing the user's waist and with the storage compartment holding an uncompressed load.
Figure 12:
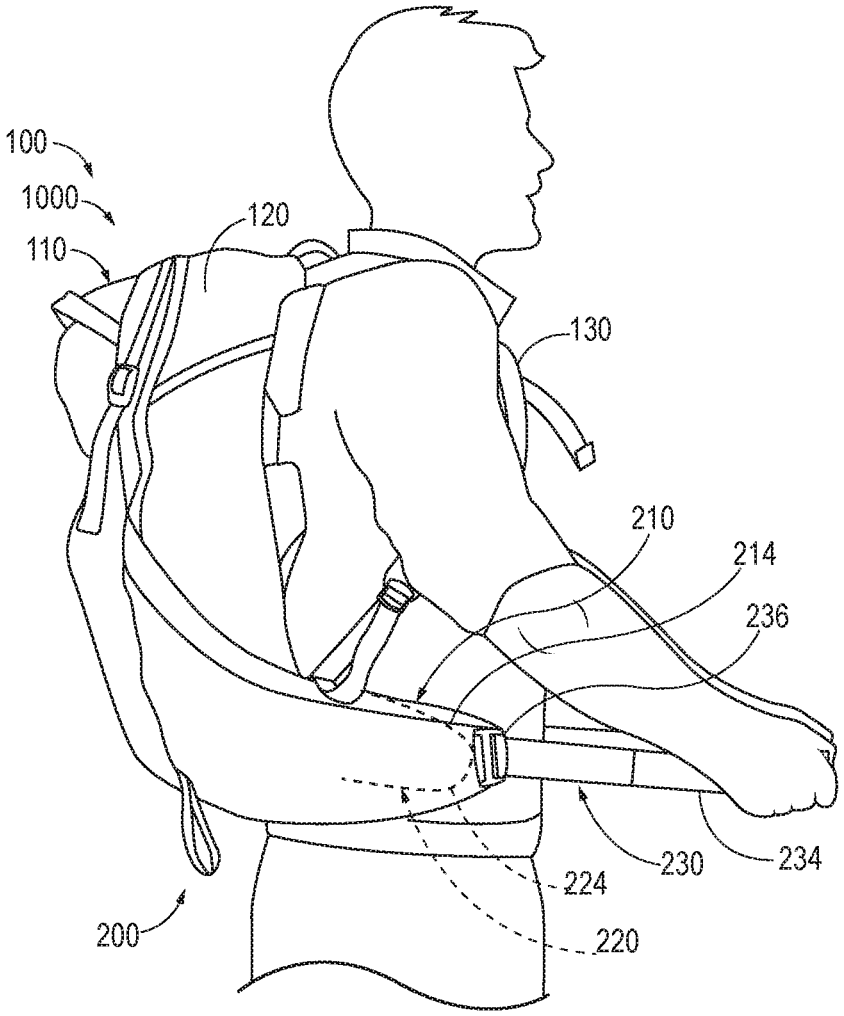
FIG. 12 is a side elevation view of the backpack and user of FIG. 10 with the hip belt segment snugly enclosing the user's waist and with a compression strap segment of the belt assembly moderately compressing the load in the storage compartment.
Figure 13:
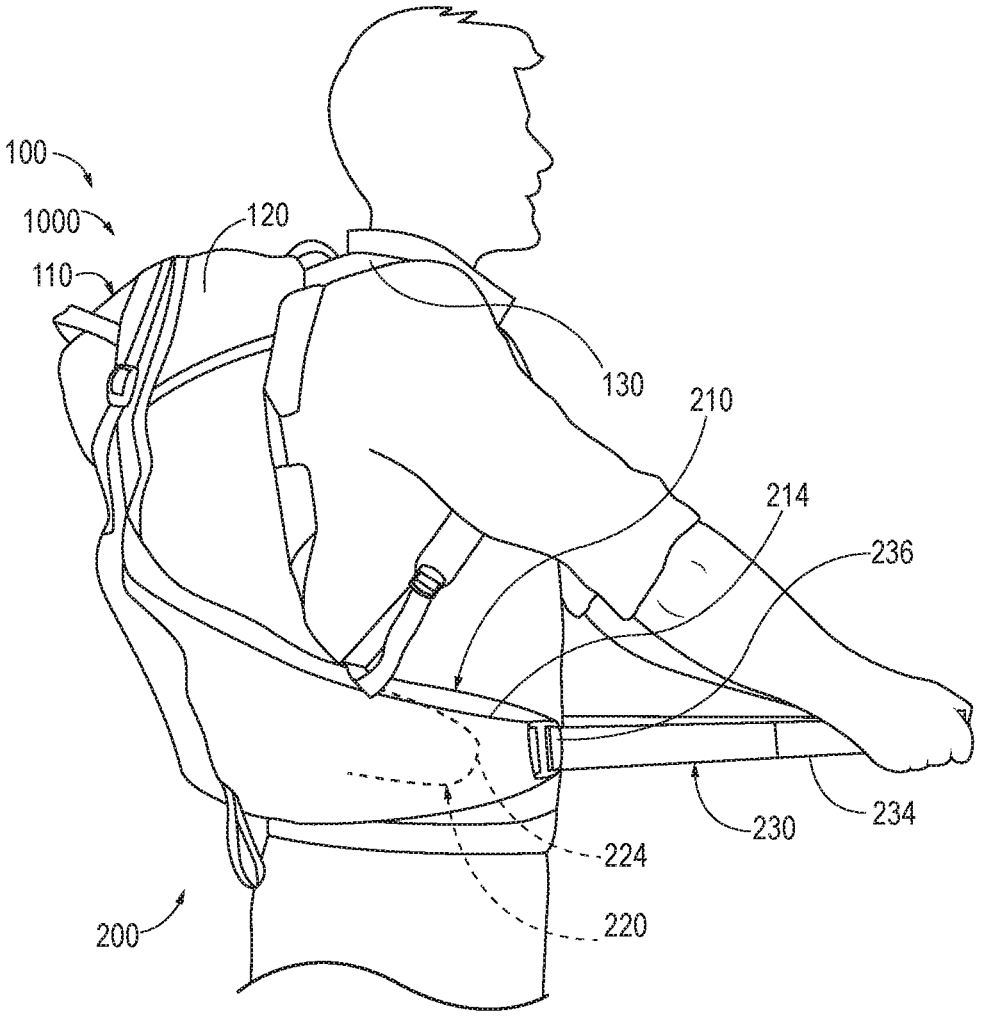
FIG. 13 is a side elevation view of the backpack and user of FIG. 10 with the hip belt segment tightly enclosing the user's waist and with the compression strap segment tightly compressing the load in the storage compartment.

FIGS. 10-13 illustrate backpack 1000 being worn by a user while the user adjusts belt assembly 200. Specifically, FIG. 10 illustrates backpack 1000 with belt assembly 200 loosely extending around the user's waist and with storage compartment 120 containing a compressible load. FIGS. 11-13 illustrate a progression of the configurations of backpack 1000 as belt assembly 200 is progressively tightened, with FIG. 13 illustrating a configuration in which belt assembly 200 is tightly secured around the user's waist and in which the load within storage compartment 120 is fully compressed.

FIGS. 10-13 additionally illustrate the relative degrees to which compression strap segments 210 and hip belt segments 220 are tightened as free ends 234 of adjustment straps 230 are pulled away from the respective adjustable buckles 236. In FIGS. 10-13, a portion of hip belt segment 220 that is concealed by compression strap segment 210 is illustrated in dashed lines such that the relative positions of compression strap segment adjustment end 214 and hip belt segment adjustment end 224 are visible throughout the progression. Specifically, the motion of compression strap segment adjustment ends 214 toward the front of the user's body generally corresponds to a compression of the load within storage compartment 120, while the motion of hip belt segment adjustment end 224 toward the front of the user's body generally corresponds to a tightening of hip belt segment 220 around the user's waist. Additionally, in FIGS. 10-13, the lengthening of free end 234 is represented by a vertical line on the free end that begins at the corresponding adjustable buckle 236 in FIG. 10 and that remains static relative to the free end as the free end is pulled away from the corresponding adjustable buckle. In this manner, the relative motions of compression strap segment adjustment end 214 and hip belt segment adjustment end 224 may be related to the distance by which free end 234 has been lengthened.

Comparing FIGS. 10-11, it may be seen that a primary effect of pulling free ends 234 away from adjustable buckles 236 when belt assembly 200 is loose around the user's waist is to draw compression strap segments 210 and hip belt segments 220 toward the front of the user's body. This motion may correspond to compression strap segments 210 being drawn closer to the user's body (as the tension on compression strap segment adjustment ends 214 overcomes a tendency of the compression strap segments to splay outwards), as well as to a preliminary tightening of hip belt segments 220 around the user's waist. As additionally may be seen by comparing FIGS. 10-11, compression strap segment adjustment ends 214 may move forward by a greater amount than hip belt segment adjustment ends 224 as the user begins to pull free ends 234 away from adjustable buckles 236. FIG. 11 may be described as illustrating a configuration of backpack 1000 in which hip belt segments 220 snugly enclose the user's waist. Progressing from this configuration, FIGS. 12-13 primarily illustrate the motion of compression strap segment adjustment end 214, and the corresponding compression of the load within storage compartment 120, as free end 234 is progressively lengthened. Stated differently, FIGS. 10-13 collectively illustrate a progression of the relative degrees to which compression strap segments 120 and hip belt segments 220 are tightened as free ends 234 of adjustment straps 230 are pulled away from backpack 1000. More specifically, and as illustrated in FIGS. 10-13, when the force required to tighten hip belt segments 220 around the user's waist is less than the force required to compress the load within storage compartment 120, the primary effect of pulling free ends 234 is to tighten the hip belt segments around the user's waist and to draw the compression strap segments closer to the user's body, similar to the progression schematically illustrated in FIGS. 3-4. Alternatively, and as further illustrated in FIGS. 10-13, as the force required to further tighten hip belt segments 220 around the user's waist begins to exceed the force required to compress the load within storage compartment 120, the effect of pulling free ends 234 transitions to compressing the load within the storage compartment, similar to the progression schematically illustrated in FIGS. 4-5.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "selective" and "selectively," when modifying an action, movement, configuration, or other activity of one or more components or characteristics of a backpack according to the present disclosure, means that the specified action, movement, configuration, or other activity is a direct or indirect result of user manipulation of an aspect of, or one or more components of, the backpack.

As used herein, "operative" and "operatively," when modifying an action, movement, configuration, or other activity of one or more components or characteristics of a backpack according to the present disclosure, means that the specified action, movement, configuration, or other activity is performed and/or achieved as a result of standard operation and/or functional utilization of the backpack, such as in a manner described herein.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Examples of backpacks according to the present disclosure are presented in the following enumerated paragraphs.

A1. A backpack, comprising:

a pack body that includes at least one storage compartment;

at least one shoulder strap operatively coupled to the pack body and configured to at least partially support the backpack upon a user's shoulders when the user wears the backpack; and a belt assembly configured to extend around the user's waist when the user wears the backpack;

wherein the pack body includes:

a back panel configured to lie adjacent to the user's back when the user wears the backpack; and an exterior panel that faces away from the back panel and is at least partially separated from the back panel by a storage compartment of the at least one storage compartment;

wherein the belt assembly includes:

at least one compression strap segment configured to selectively adjust a pack volume of the pack body;

at least one hip belt segment configured to at least partially support the backpack upon the user's hips when the user wears the backpack;

at least one adjustment strap interconnecting a corresponding compression strap segment and a corresponding hip belt segment; and a releasable fastener configured to selectively secure the belt assembly around the user's waist when the user wears the backpack;

wherein each compression strap segment includes a compression strap segment pack end that is coupled to the pack body and a compression strap segment adjustment end that is coupled to a corresponding adjustment strap;

wherein each hip belt segment includes a hip belt segment pack end that is coupled to the pack body at a location proximal the back panel relative to a corresponding compression strap segment pack end and a hip belt segment adjustment end that is coupled to a corresponding adjustment strap;

wherein the backpack includes a belt assembly waist loop with a belt assembly waist perimeter, wherein the belt assembly waist loop is partially defined by each hip belt segment and a portion of each adjustment strap that extends between the corresponding hip belt segment and the releasable fastener; and wherein each adjustment strap is configured to selectively adjust each of the pack volume and the belt assembly waist perimeter, and wherein the belt assembly is configured such that, responsive to the user applying a tension force to the adjustment strap, each of the pack volume and the belt assembly waist perimeter decreases by a respective degree that depends upon a ratio of the force required to decrease the pack volume to the force required to decrease the belt assembly waist perimeter.

A2. The backpack of paragraph A1, wherein the at least one shoulder strap includes a pair of shoulder straps; wherein the at least one compression strap segment includes a pair of compression strap segments; wherein the at least one hip belt segment includes a pair of hip belt segments; wherein the at least one adjustment strap includes a pair of adjustment straps; and wherein the belt assembly waist loop is defined by each hip belt segment of the pair of hip belt segments, the releasable fastener, a portion of each adjustment strap that extends between the corresponding hip belt segment and the releasable fastener, and a portion of the pack body that extends between the respective hip belt segment pack ends of the pair of hip belt segments.

A3. The backpack of paragraph A2, wherein each adjustment strap includes:

a loop portion that extends between the compression strap segment adjustment end of the corresponding compression strap segment and the hip belt segment adjustment end of the corresponding hip belt segment; and a free end extending from the loop portion at one of the compression strap segment adjustment end of the corresponding compression strap segment and the hip belt segment adjustment end of the corresponding hip belt segment;

wherein the backpack includes a pair of belt assembly internal loops, each belt assembly internal loop having a corresponding belt assembly internal loop perimeter, wherein each belt assembly internal loop is at least partially defined by:

a corresponding compression strap segment of the pair of compression strap segments;

a corresponding hip belt segment of the pair of hip belt segments;

the loop portion of a corresponding adjustment strap of the pair of adjustment straps; and a portion of the pack body that extends between the compression strap segment pack end of the corresponding compression strap segment and the hip belt segment pack end of the corresponding hip belt segment;

wherein the free end is configured to be pulled by the user to selectively decrease the corresponding belt assembly internal loop perimeter.

A4. The backpack of paragraph A3, wherein the free end of a corresponding adjustment strap of the pair of adjustment straps is configured to be pulled by the user to increase a length of the free end of the corresponding adjustment strap and to decrease a length of the loop portion of the corresponding adjustment strap when the user wears the backpack.

A5. The backpack of any of paragraphs A3-A4, wherein each adjustment strap is configured to adjust the belt assembly internal loop perimeter of the corresponding belt assembly internal loop to selectively adjust at least one of the pack volume and the belt assembly waist perimeter when the user wears the backpack.

A6. The backpack of any of paragraphs A3-A5, wherein the belt assembly is configured such that, responsive to the user pulling the free end of a corresponding adjustment strap of the pair of adjustment straps when the user wears the backpack, at least one of:

(i) the belt assembly waist perimeter is decreased; and (ii) the belt assembly internal loop perimeter is decreased.

A7. The backpack of paragraph A6, wherein, responsive to the user pulling the free end of the corresponding adjustment strap when the user wears the backpack:

(i) the belt assembly waist perimeter is decreased by a greater extent than the belt assembly internal loop perimeter is decreased if pulling the corresponding hip belt segment adjustment end toward the releasable fastener requires less force than pulling the corresponding compression strap segment adjustment end toward the releasable fastener, and (ii) the belt assembly internal loop perimeter is decreased by a greater extent than the belt assembly waist perimeter is decreased if pulling the corresponding hip belt segment adjustment end toward the releasable fastener requires more force than pulling the corresponding compression strap segment adjustment end toward the releasable fastener.

A8. The backpack of any of paragraphs A6-A7, wherein, responsive to the user pulling the free end of the corresponding adjustment strap when the user wears the backpack, a ratio of an extent to which the belt assembly waist perimeter is decreased to an extent to which the belt assembly internal loop perimeter is decreased is proportional to a ratio of a/the force required to pull the corresponding hip belt segment adjustment end toward the releasable fastener to a/the force required to pull the corresponding compression strap segment adjustment end toward the releasable fastener.

A9. The backpack of any of paragraphs A3-A8, wherein, responsive to the user exerting a tension force on the free end of a corresponding adjustment strap of the pair of adjustment straps, at least one of the compression strap segment adjustment end of the corresponding compression strap segment and the hip belt segment adjustment end of the corresponding hip belt segment is urged toward the releasable fastener with a force that is greater than the tension force exerted on the free end by the user.

A10. The backpack of any of paragraphs A1-A9, wherein each compression strap segment pack end is fixedly coupled to the pack body.

A11. The backpack of any of paragraphs A1-A10, wherein each hip belt segment pack end is fixedly coupled to the pack body.

A12. The backpack of any of paragraphs A1-A11, wherein the releasable fastener is slidingly coupled to each adjustment strap such that the releasable fastener is selectively positioned along the adjustment strap between the compression strap segment adjustment end of a corresponding compression strap segment and the hip belt segment adjustment end of a corresponding hip belt segment and such that the releasable fastener may translate along a length of the adjustment strap.

A13. The backpack of any of paragraphs A1-A12, wherein the pack body has a pack body height, wherein each compression strap segment pack end is coupled to the pack body at a compression strap segment attachment region, wherein the compression strap segment attachment region has a compression strap segment attachment region height that is at least one of at least 10% of the pack body height, at least 20% of the pack body height, at least 30% of the pack body height, at least 40% of the pack body height, at least 50% of the pack body height, at most 95% of the pack body height, at most 75% of the pack body height, and at most 55% of the pack body height.

A14. The backpack of paragraph A13, wherein the exterior panel includes the compression strap segment attachment region.

A15. The backpack of any of paragraphs A1-A14, wherein the pack body further includes at least one side panel that extends between the back panel and the exterior panel.

A16. The backpack of paragraph A15, wherein the exterior panel includes a/the compression strap segment attachment region of each compression strap segment at a location that is spaced apart from each side panel.

A17. The backpack of any of paragraphs A15-A16, wherein a/the compression strap segment attachment region of each compression strap segment is not located on a side panel of the at least one side panel.

A18. The backpack of any of paragraphs A1-A17, wherein each adjustment strap is non-adjustably coupled to the corresponding hip belt segment, and wherein each adjustment strap is adjustably coupled to the corresponding compression strap segment via an adjustable buckle, optionally wherein each adjustable buckle is non-adjustably coupled to the corresponding compression strap segment.

A19. The backpack of any of paragraphs A1-A17, wherein each adjustment strap is non-adjustably coupled to the corresponding compression strap segment, and wherein each adjustment strap is adjustably coupled to the corresponding hip belt segment via an adjustable buckle, optionally wherein each adjustable buckle is non-adjustably coupled to the corresponding hip belt segment.

A20. The backpack of any of paragraphs A1-A17, wherein each adjustment strap is adjustably coupled to each of the corresponding compression strap segment and the corresponding hip belt segment via a respective adjustable buckle.

A21. The backpack of any of paragraphs A1-A20, wherein each compression strap segment is configured to at least substantially overlap a corresponding hip belt segment of the at least one hip belt segment when the belt assembly extends around the user's waist.

A22. The backpack of any of paragraphs A1-A21, wherein each storage compartment is configured to be selectively opened and closed via a mechanical closure.

A23. The backpack of any of paragraphs A1-A22, wherein the pack volume has a maximum total capacity that is at least one of at least 10 liters (L), at least 20 L, at least 30 L, at least 40 L, at least 50 L, at least 60 L, at most 75 L, at most 55 L, at most 45 L, at most 35 L, at most 25 L, and at most 15 L.

A24. The backpack of any of paragraphs A1-A23, wherein the at least one storage compartment includes a hydration bladder compartment configured to hold a hydration bladder.

A25. The backpack of paragraph A24, wherein the backpack further includes at least one hydration tube passage configured to permit a drink tube that is fluidly coupled to the hydration bladder to extend out of the hydration bladder compartment.

A26. The backpack of any of paragraphs A24-A25 in combination with a hydration system that includes the hydration bladder fluidly coupled to a/the drink tube.

A27. The backpack of any of paragraphs A2-A26, wherein the backpack further includes a sternum strap extending between the pair of shoulder straps, wherein the sternum strap is configured to extend across the user's chest when the user wears the backpack, and wherein the sternum strap includes a sternum strap fastener configured to be selectively fastened and selectively adjusted to maintain the shoulder straps in position relative to the user's chest.

A28. The backpack of any of paragraphs A1-A27, wherein the pack body further includes at least one inner side pocket defined by a compression strap segment of the at least one compression strap segment, a side pocket panel that extends between the compression strap segment and a portion of the pack body proximal the back panel relative to the compression strap segment pack end of the compression strap segment, and a portion of the pack body that extends between the compression strap segment and the side pocket panel.

A29. The backpack of paragraph A28, wherein the side pocket panel is at least one of an elastomeric side pocket panel and a mesh side pocket panel.

A30. The backpack of any of paragraphs A1-A29, wherein the backpack further includes a belt assembly storage compartment positioned in at least one of a compression strap segment of the at least one compression strap segment; and a hip belt segment of the at least one hip belt segment.

A31. A backpack, comprising:

a pack body that includes at least one storage compartment;

a pair of shoulder straps operatively coupled to the pack body and configured to at least partially support the backpack upon a user's shoulders when the user wears the backpack; and a belt assembly configured to extend around the user's waist when the user wears the backpack;

wherein the pack body has a pack volume;

wherein the belt assembly at least partially defines a belt assembly waist perimeter, wherein the belt assembly includes an adjustment strap; and wherein the backpack further includes means for selectively adjusting each of the pack volume and the belt assembly waist perimeter by variable degrees responsive to the user pulling on the adjustment strap.

A32. The backpack of paragraph A31, wherein the means for selectively adjusting each of the pack volume and the belt assembly waist perimeter is configured such that, responsive to the user applying a tension force to the adjustment strap, each of the pack volume and the belt assembly waist perimeter decreases by a respective degree that depends upon a ratio of the force required to decrease the pack volume to a force required to decrease the belt assembly waist perimeter.

A33. The backpack of any of paragraphs A1-A32, wherein each compression strap segment adjustment end is coupled to the corresponding hip belt segment adjustment end only via the corresponding adjustment strap.

A34. The backpack of any of paragraphs A1-A33, wherein each adjustment strap at least partially defines a separation between each corresponding compression strap segment adjustment end and each corresponding hip belt segment adjustment end.

A35. The backpack of paragraph A34, wherein each adjustment strap is configured to adjustably vary the separation between each corresponding compression strap segment adjustment end and each corresponding hip belt segment adjustment end.

INDUSTRIAL APPLICABILITY

The backpacks disclosed herein are applicable to the outdoor products industry.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A backpack, comprising:

a pack body that includes at least one storage compartment;

at least one shoulder strap operatively coupled to the pack body and configured to at least partially support the backpack upon a user's shoulders when the user wears the backpack; and a belt assembly configured to extend around the user's waist when the user wears the backpack;

wherein the pack body includes:

a back panel configured to lie adjacent to the user's back when the user wears the backpack; and an exterior panel that faces away from the back panel and is at least partially separated from the back panel by a storage compartment of the at least one storage compartment;

wherein the belt assembly includes:

at least one compression strap segment configured to selectively adjust a pack volume of the pack body;

at least one hip belt segment configured to at least partially support the backpack upon the user's hips when the user wears the backpack;

at least one adjustment strap interconnecting a corresponding compression strap segment and a corresponding hip belt segment; and a releasable fastener configured to selectively secure the belt assembly around the user's waist when the user wears the backpack;

wherein each compression strap segment includes a compression strap segment pack end that is coupled to the pack body and a compression strap segment adjustment end that is coupled to a corresponding adjustment strap;

wherein each hip belt segment includes a hip belt segment pack end that is coupled to the pack body at a location proximal the back panel relative to a corresponding compression strap segment pack end and a hip belt segment adjustment end that is coupled to a corresponding adjustment strap;

wherein each compression strap segment adjustment end is coupled to the corresponding hip belt segment adjustment end only via the corresponding adjustment strap;

wherein the backpack includes a belt assembly waist loop with a belt assembly waist perimeter, wherein the belt assembly waist loop is partially defined by each hip belt segment and a portion of each adjustment strap that extends between the corresponding hip belt segment and the releasable fastener, wherein each adjustment strap is configured to selectively adjust each of the pack volume and the belt assembly waist perimeter, and wherein the belt assembly is configured such that, responsive to the user applying a tension force to the adjustment strap, each of the pack volume and the belt assembly waist perimeter decreases by a respective degree that depends upon a ratio of the force required to decrease the pack volume to the force required to decrease the belt assembly waist perimeter.

2. The backpack of claim 1, wherein the at least one shoulder strap includes a pair of shoulder straps; wherein the at least one compression strap segment includes a pair of compression strap segments; wherein the at least one hip belt segment includes a pair of hip belt segments; wherein the at least one adjustment strap includes a pair of adjustment straps; and wherein the belt assembly waist loop is defined by each hip belt segment, the releasable fastener, a portion of each adjustment strap that extends between the corresponding hip belt segment and the releasable fastener, and a portion of the pack body that extends between the respective hip belt segment pack ends of the pair of hip belt segments.

3. The backpack of claim 2, wherein each adjustment strap includes:

a loop portion that extends between the compression strap segment adjustment end of the corresponding compression strap segment and the hip belt segment adjustment end of the corresponding hip belt segment; and a free end extending from the loop portion at one of the compression strap segment adjustment end of the corresponding compression strap segment and the hip belt segment adjustment end of the corresponding hip belt segment;

wherein the backpack includes a pair of belt assembly internal loops, each belt assembly internal loop having a corresponding belt assembly internal loop perimeter, wherein each belt assembly internal loop is at least partially defined by:

a corresponding compression strap segment of the pair of compression strap segments;

a corresponding hip belt segment of the pair of hip belt segments;

the loop portion of a corresponding adjustment strap of the pair of adjustment straps; and a portion of the pack body that extends between the compression strap segment pack end of the corresponding compression strap segment and the hip belt segment pack end of the corresponding hip belt segment;

wherein the free end is configured to be pulled by the user to selectively decrease the corresponding belt assembly internal loop perimeter.

4. The backpack of claim 3, wherein the free end of a corresponding adjustment strap of the pair of adjustment straps is configured to be pulled by the user to increase a length of the free end of the corresponding adjustment strap and to decrease a length of the loop portion of the corresponding adjustment strap.

5. The backpack of claim 3, wherein each adjustment strap is configured to adjust the belt assembly internal loop perimeter of the corresponding belt assembly internal loop to selectively adjust at least one of the pack volume and the belt assembly waist perimeter when the user wears the backpack.

6. The backpack of claim 3, wherein the belt assembly is configured such that, responsive to the user pulling the free end of a corresponding adjustment strap of the pair of adjustment straps when the user wears the backpack, at least one of:

(i) the belt assembly waist perimeter is decreased; and (ii) the belt assembly internal loop perimeter is decreased.

7. The backpack of claim 6, wherein, responsive to the user pulling the free end of the corresponding adjustment strap when the user wears the backpack:

(i) the belt assembly waist perimeter is decreased by a greater extent than the belt assembly internal loop perimeter is decreased if pulling the corresponding hip belt segment adjustment end toward the releasable fastener requires less force than pulling the corresponding compression strap segment adjustment end toward the releasable fastener, and (ii) the belt assembly internal loop perimeter is decreased by a greater extent than the belt assembly waist perimeter is decreased if pulling the corresponding hip belt segment adjustment end toward the releasable fastener requires more force than pulling the corresponding compression strap segment adjustment end toward the releasable fastener.

8. The backpack of claim 7, wherein, responsive to the user pulling the free end of the corresponding adjustment strap when the user wears the backpack, a ratio of an extent to which the belt assembly waist perimeter is decreased to an extent to which the belt assembly internal loop perimeter is decreased is proportional to a ratio of the force required to pull the corresponding hip belt segment adjustment end toward the releasable fastener to the force required to pull the corresponding compression strap segment adjustment end toward the releasable fastener.

9. The backpack of claim 3, wherein, responsive to the user exerting a tension force on the free end of a corresponding adjustment strap of the pair of adjustment straps, at least one of the compression strap segment adjustment end of the corresponding compression strap segment and the hip belt segment adjustment end of the corresponding hip belt segment is urged toward the releasable fastener with a force that is greater than the tension force exerted on the free end by the user.

10. The backpack of claim 1, wherein the releasable fastener is slidingly coupled to each adjustment strap such that the releasable fastener is selectively positioned along the adjustment strap between the compression strap segment adjustment end of a corresponding compression strap segment and the hip belt segment adjustment end of a corresponding hip belt segment and such that the releasable fastener may translate along a length of the adjustment strap.

11. The backpack of claim 1, wherein the pack body has a pack body height, wherein each compression strap segment pack end is coupled to the pack body at a compression strap segment attachment region, and wherein the compression strap segment attachment region has a compression strap segment attachment region height that is at least 20% of the pack body height.

12. The backpack of claim 11, wherein the exterior panel includes the compression strap segment attachment region.

13. The backpack of claim 1, wherein each adjustment strap is non-adjustably coupled to the corresponding hip belt segment.

14. The backpack of claim 1, wherein each compression strap segment is configured to at least substantially overlap a corresponding hip belt segment of the at least one hip belt segment when the belt assembly extends around the user's waist.

15. The backpack of claim 1, wherein the at least one storage compartment includes a hydration bladder compartment configured to hold a hydration bladder.

16. The backpack of claim 15, wherein the backpack further includes at least one hydration tube passage configured to permit a drink tube of the hydration bladder to extend out of the hydration bladder compartment.

17. The backpack of claim 15 in combination with the hydration bladder.

18. The backpack of claim 1, wherein the backpack further includes at least one inner side pocket defined by a compression strap segment of the at least one compression strap segment, a side pocket panel that extends between the compression strap segment and a portion of the pack body proximal the back panel relative to the compression strap segment pack end of the compression strap segment, and a portion of the pack body that extends between the compression strap segment and the side pocket panel.

19. The backpack of claim 1, wherein the pack volume has a maximum total capacity that is at least 15 liters.

20. The backpack of claim 1, wherein the backpack further includes a compression strap segment storage compartment positioned in a compression strap segment of the at least one compression strap segment.

* * * * *